US006082786A

United States Patent [19]

Stephens et al.

[11] Patent Number: 6,082,786

[45] Date of Patent: Jul. 4, 2000

[54] DOOR LATCH ASSEMBLY WITH INTEGRAL SPRING

[75] Inventors: Randy Stephens, Chesterfield, Mich.; John Clark, Granger, Ind.

[73] Assignee: Textron Automotive Company, Inc., Troy, Mich.

[21] Appl. No.: 09/305,405

[22] Filed: May 5, 1999

[51] Int. Cl.[7] ..... E05C 19/10

[52] U.S. Cl. ..... 292/102; 292/DIG. 38; 292/DIG. 63; 292/128; 292/228

[58] Field of Search ..... 292/102, DIG. 38, 292/DIG. 61, DIG. 63, 203, 56, 120, 128, 241, 218, 228, 175

[56] References Cited

U.S. PATENT DOCUMENTS 3,455,590 7/1969 Zerfoss ..... 292/228
3,797,870 3/1974 Beckman .
4,416,477 11/1983 Bialobrzeski et al. ..... 292/19
4,492,396 1/1985 Luke et al. .
4,557,512 12/1985 Miyasaka et al. ..... 292/341.18
4,743,060 5/1988 Hishida .
5,482,333 1/1996 Gehrs et al. ..... 292/163

*Primary Examiner*—B. Dayoan
*Assistant Examiner*—John B. Walsh
*Attorney, Agent, or Firm*—Reising, Ethington, Barnes, Kisselle, Learman & McCulloch, P.C.

[57] ABSTRACT

A door latch assembly (10) for a glove box door (12) includes a pivot plate (16) mounted on the door and a latch handle (18) pivotally mounted on the pivot plate to move selectively between a latched position and an unlatched position. The handle (18) has a catch (20,22) to engage the glove box enclosure (14) when the latch handle is in a latched position, and disengage from the enclosure when the handle is in an unlatched position. A pair of specialized torsion springs (24) is molded to the pivot plate (16) to bias the latch handle (18) and the catch (20) into the engaged position.

11 Claims, 3 Drawing Sheets

DOOR LATCH ASSEMBLY WITH INTEGRAL SPRING

TECHNICAL FIELD

The subject invention relates to door latch assemblies and particularly to small door latch assemblies for use on glove box doors and the like.

BACKGROUND OF THE INVENTION

Auto suppliers are engaged in a continual effort to refine even the most ordinary mechanisms—to make them simpler, lighter, and less expensive. The present case relates to the well-trodden field of door latch mechanisms for glove boxes and similar storage compartments or enclosures. The typical latch includes a pivot plate which may or may not be integral with the compartment door. A latch handle pivotally mounts on the pivot plate, and includes some type of catch to engage the compartment frame to latch the door. One or more springs—disposed between the pivot plate and handle—bias the handle and catch with respect to the pivot plate so that the handle will latch when it engages the compartment frame. In the typical case the springs are metal torsion springs separate from the pivot plate and the latch handle. Accordingly, they need to be assembled to the handle and pivot plate with some level of labor and expense.

SUMMARY OF THE INVENTION AND ADVANTAGES

The door latch assembly is intended for a door adapted to be pivotally mounted on an enclosure, and specifically a vehicle glove box door. The latch assembly includes a pivot plate adapted to be mounted on the door. Also, a latch handle is pivotally mounted on the pivot plate to move selectively between a latched position in which the door is latched to the enclosure, and an unlatched position in which the door may pivot with respect to the enclosure. A catch is rigidly attached to the handle and extends away from the handle. The catch includes a distal end having a hook-like portion adapted to engage the enclosure when the latch handle is in the latched position, and disengage from the enclosure when the latch is in the unlatched position. At least one spring extends between the pivot plate and the catch biasing the latch handle into the latched position. Each spring has a first arm, and a second arm extending parallel with the first arm and interconnected with the first arm by a curved portion. The first arm has a length greater than the second arm so that the spring has the shape of a hook. One of the first and second arms contacts the pivot plate, and the other of the arms contacts the catch.

This design holds several advantages over the prior art. First, the spring system is arranged to apply a centered biasing action on the latch, thus providing a strong and positive door locking action. Next, and perhaps most significant, is the manufacturing efficiency realized by the design, because it allows one or more springs to be molded integral with the pivot plate, eliminating the labor and cost involved in assembling separate parts. Further, the springs are much less subject to failure caused by improper assembly.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
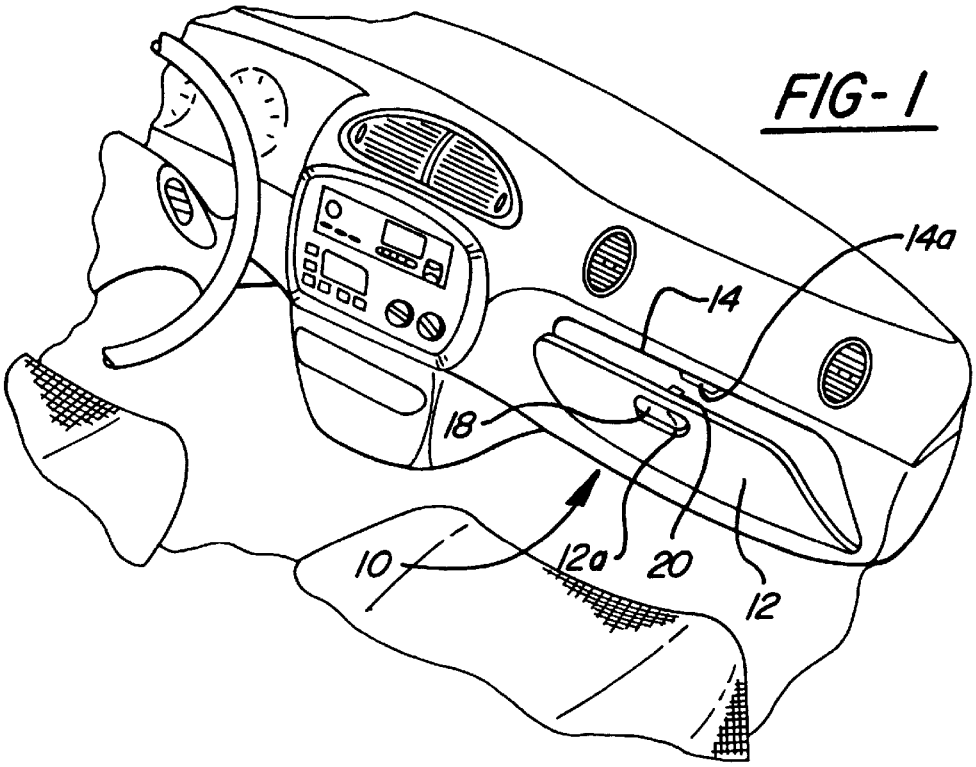
FIG. 1 is a perspective view showing the subject door latch in its environment in the interior of a vehicle.
Figure 2:
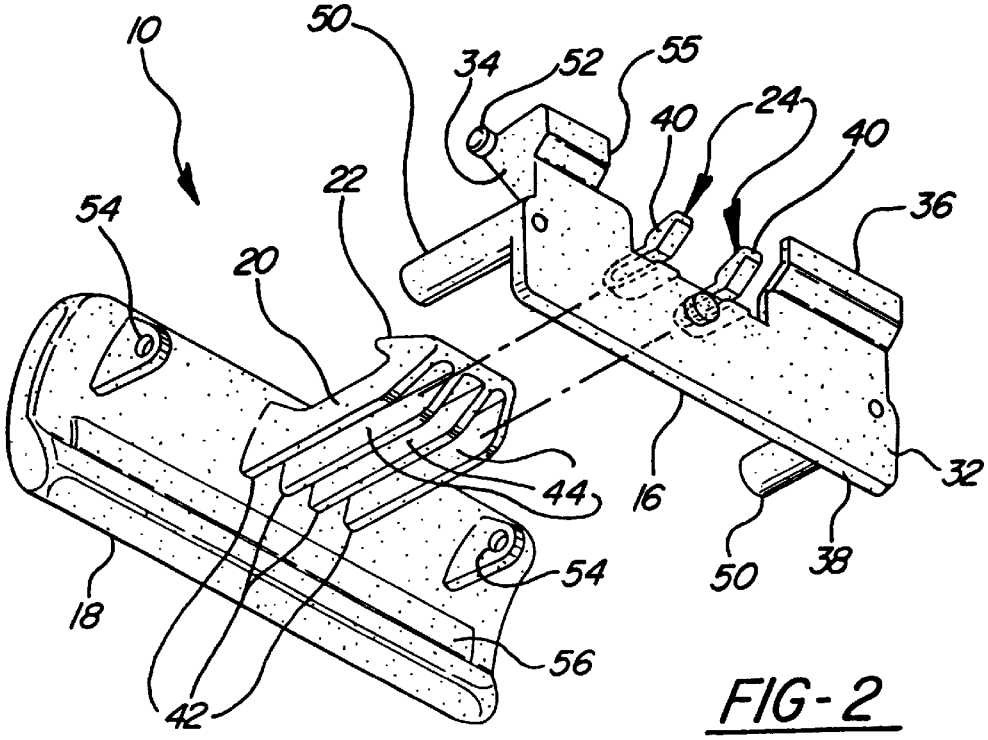
FIG. 2 is a perspective view showing the lower sides of the door latch and pivot plate.
Figure 3:
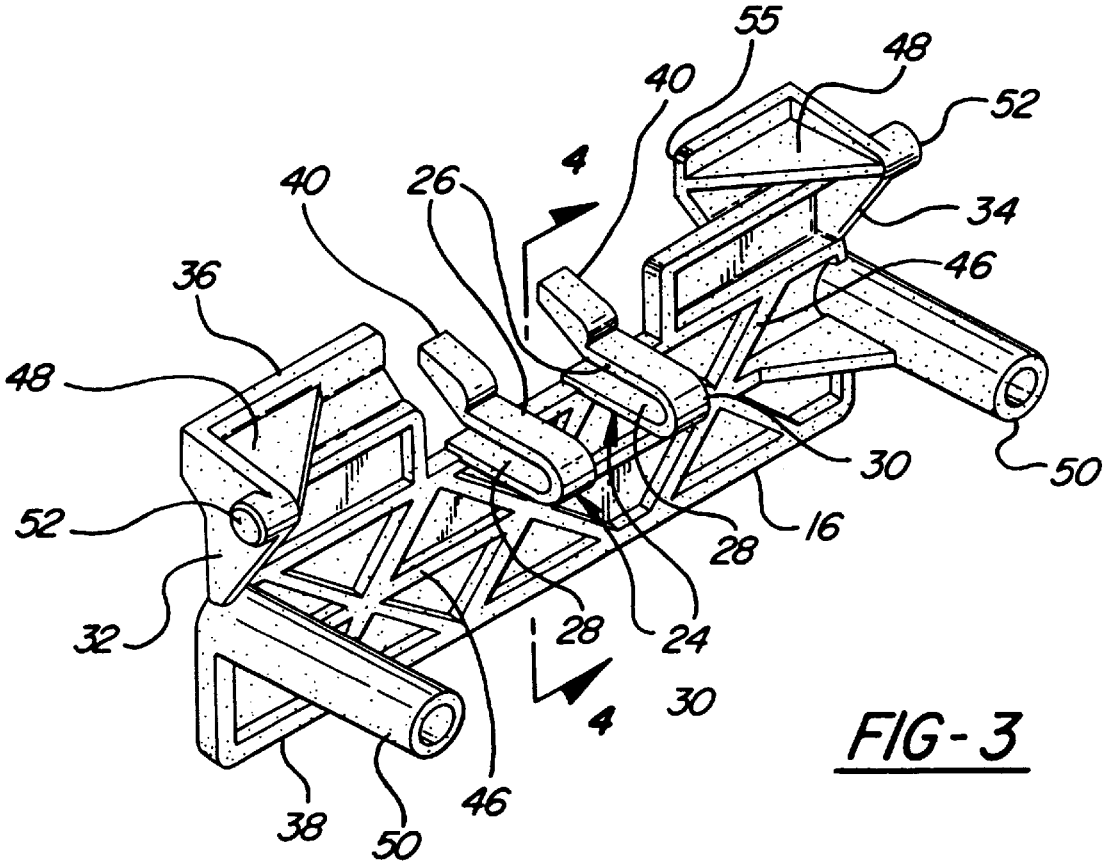
FIG. 3 is a perspective view of the pivot plate showing the springs.
Figure 4:
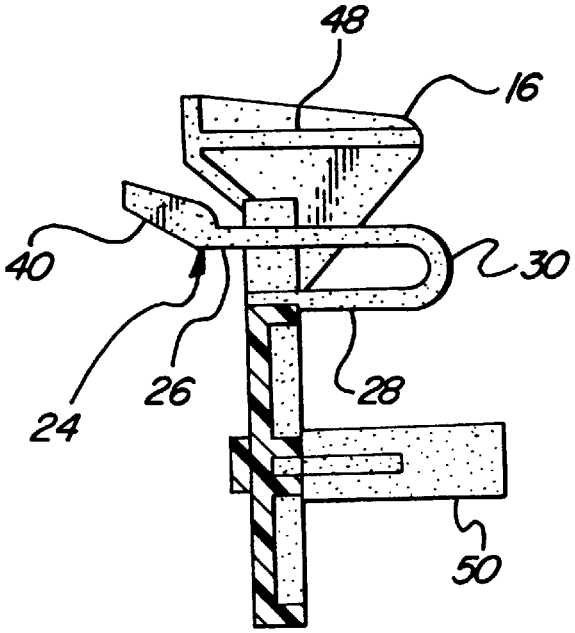
FIG. 4 is a section view of the pivot plate taken along line 4—4 of FIG. 3.

Referring to the Figures wherein like numerals indicate like or corresponding parts throughout the several views, a door latch assembly is generally shown at 10.

The door latch assembly 10 is intended for a door 12 adapted to be pivotally mounted on an enclosure 14, and specifically a vehicle glove box door. The latch assembly 10 includes a pivot plate 16 configured to be mounted on the door 12, and a latch handle 18 pivotally mounted on the pivot plate to move selectively between a latched position in which the door is latched to the enclosure and an unlatched position in which the door may pivot with respect to the enclosure. A catch 20 is rigidly attached to the handle 18 and extends away from the handle. The catch 20 includes a distal end having a hook-like portion 22 adapted to engage the enclosure 14 when the latch handle 18 is in the latched position, and disengage from the enclosure when the latch is in the unlatched position. At least one spring generally indicated at 24 extends between the pivot plate 16 and the catch 20, biasing the latch handle 18 into the latched position. Each spring 24 has a first arm 26, and a second arm 28 extending parallel with the first arm and interconnected with the first arm by a curved portion 30. The first arm 26 has a length greater than the second arm 28 so that the spring 24 has the shape of a hook. One of the first and second arms 26,28 contacts the pivot plate 16, and the other of the arms contacts the catch 20.

The pivot plate 16 extends from a first end 32 to a second end 34, and from a top end 36 to a bottom end 38. In the presently preferred case, there are two springs 24 attached to the pivot plate 16 at their respective second arms 28, with the first arm 26 of each spring abutting the catch 20. Each spring 24 is formed integral with the pivot plate 16 out of a plastic material. In the presently preferred case, that material is an unfilled acetal resin sold by Dupont under the designation Delrin® 500p. Other similar materials may be suitable. As shown in the Figures, the springs 24 are located at or near the top end 36 of the pivot plate 16 midway between the first and second ends 32, 34 of the pivot plate.

The inventor is unaware of any special name for the specific type of spring 24 used. The spring 24 may be described as having a "J" hook shape, where the short arm 28 attaches to or contacts the pivot plate 16 and the long arm 26 contacts the latch handle/catch 18, 20. The curve 30 interconnects the two arms 26,28 and bears most of the stress in any deflection. Each spring 24 has a torsion action in that it creates a rotational bias between the pivot plate 16 and the latch handle/catch piece 18, 20 about an axis defined by the pivot pins 52. As shown in the Figures, the springs 24 have a cross-section that is substantially rectangular. The spring combination 24 can withstand many thousands of rotational cycles of about twenty-four (24) degrees each.

The first arm 26 of each spring 24 includes a lobe or enlargement 40 engaging the catch 20 to bias the catch. Correspondingly, the catch 20 includes a plurality of ribs or dividers 42 defining at least two channels or conduits 44 on the catch 20 for guiding each of the lobes 40 of the first arms 26 of the springs 24. When the latch handle 18 is lifted in a typical door release cycle, the lobes 40 slide along the channels 44. While the lobes 40 are guided by the ribs 42, the lobes are not attached or secured to the catch 20.

Whether the pivot plate 16 is integral with the door 12 or molded separate from it is not critical to the invention. In the preferred case, the pivot plate 16 is separate. It includes a plurality of reinforcing ribs 46 for stiffening the pivot plate 16. The pivot plate 16 includes other structural support members 48 as shown in the drawings. The fastener tubes 50 serve to receive screws or other fasteners 51 that fasten the pivot plate 16 to the door 12. These tubes 50, together with fasteners such as screws, attach the pivot plate 16 to the door 12. The tubes 50 also maintain the pivot plate 16 and the handle/catch 18, 20 in a predetermined at rest orientation against the force of the springs 24 and absent any manual force biasing the handle 18 into the unlatched position by pivoting it away from the tubes 50. Next, the pivot plate 16 includes spaced apart pivot pins 52 defining the axis of rotation for the handle 18 . As shown in the Figures, the handle 18 defines corresponding spaced apart holes 54 for receiving the pins 52. Finally, the pivot plate 16 defines a notch 55 for allowing easy assembly between the pivot plate and the latch handle/catch 18,20.

Figure 5:
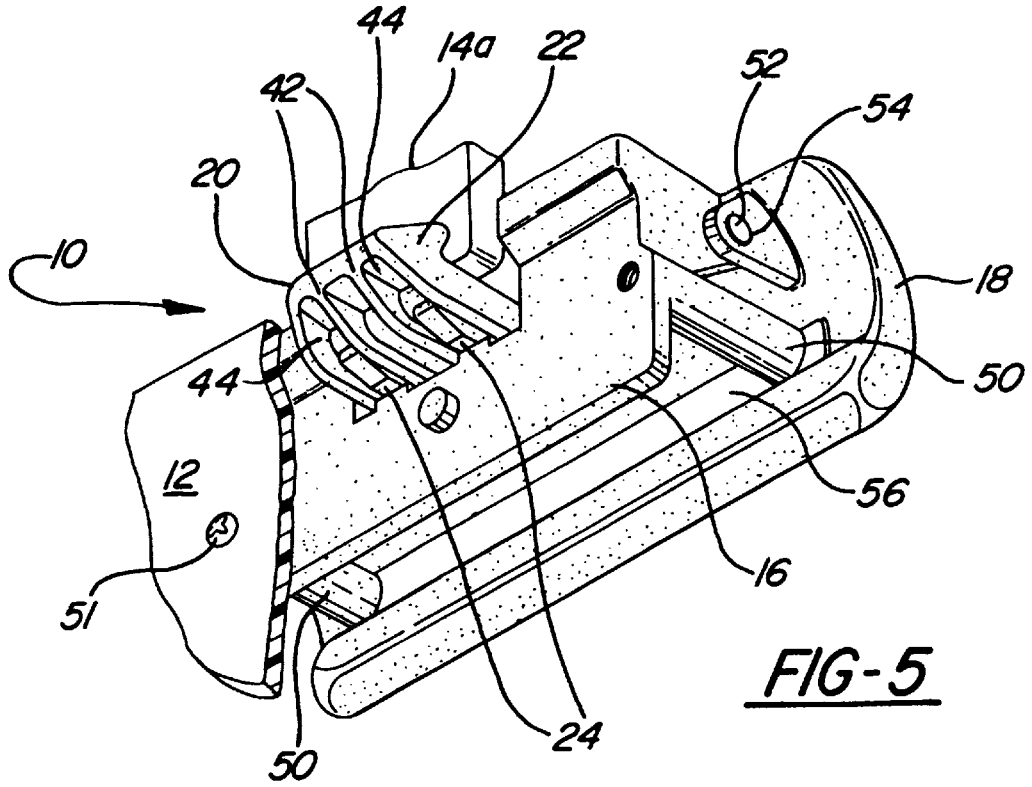
FIG. 5 is a perspective view of the door latch in the latched position showing a portion of the door to which the latch attaches, as well as the portion of the enclosure engaging the catch.
Figure 6:
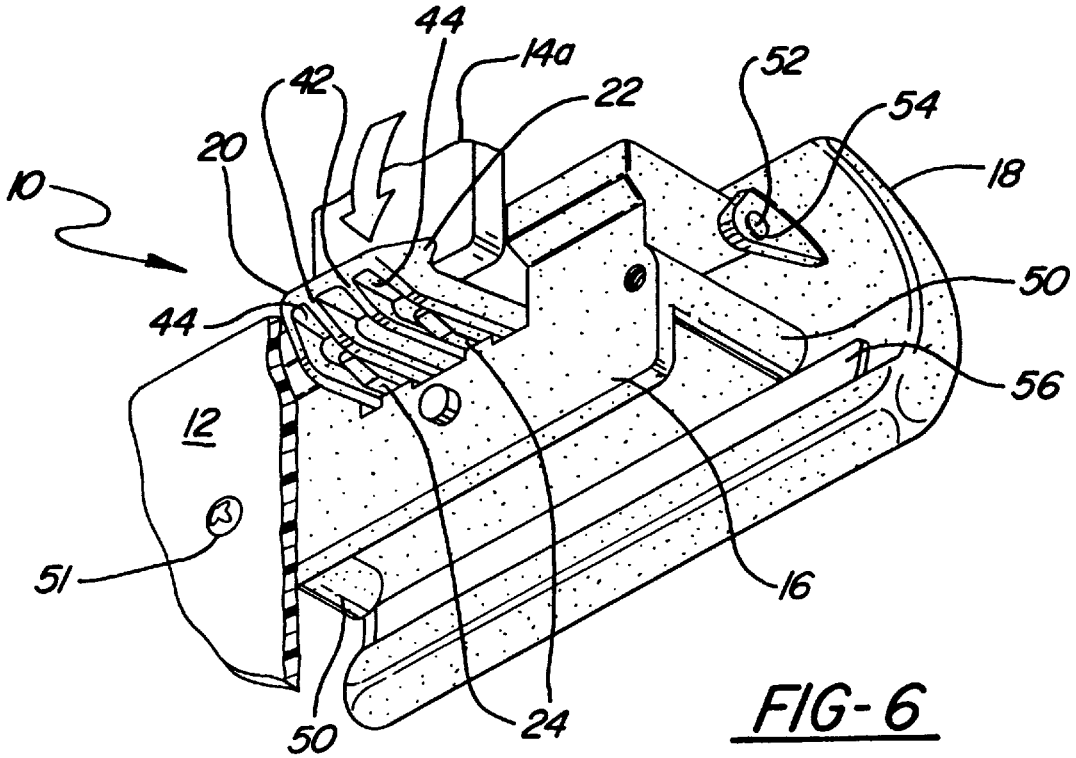
FIG. 6 is a perspective view similar to the view shown in FIG. 5 showing the latch in the unlatched position.

As shown in FIGS. 5 and 6, the pivot plate 16 attaches to a rear door panel 12 with fasteners 51 such as screws. The screws 51 extend through the door and thread into the fastener tubes 50. The door 12 has a notch, hole or similar passage 12*a* (see FIG. 1) for the handle 18. The catch 20 on the handle passes through the passage 12*a* to engage the enclosure 14 or a strike plate 14*a* thereon as shown in FIG. 1.

The latch handle 18 and the catch 20 are molded together from plastic material. They are a one-piece unit as shown in the drawings. The handle 18 and catch 20 include the various features already mentioned. The handle 18 may further include a soft dampening strip 56 on its under side for contacting the fastener tubes 50. The strip 56 is a simple piece of rubber-like material secured to the handle 18 with an adhesive. If a person releases the latch handle 18 at the point of its greatest rotational displacement, the springs 24 will snap it back against the fastener tubes 50 and create a noise. The dampening strip 56 minimizes this noise.

The invention has been described in an illustrative manner, and it is to be understood that the terminology which has been used is intended to be in the nature of words of description rather than of limitation.

Obviously, many modifications and variations of the present invention are possible in light of the above teachings. Therefore, it is to be understood that within the scope of the appended claims the invention may be practiced otherwise than as specifically described. Moreover, the reference numerals are merely for convenience and are not intended to be in any way limiting.

We claim:

1. A door latch assembly for a door adapted to be pivotally mounted on an enclosure, said latch assembly comprising:

a pivot plate adapted to be mounted on the door;

a latch handle pivotally mounted on said pivot plate to move selectively between a latched position in which the door is latched to the enclosure and an unlatched position in which the door may pivot with respect to the enclosure;

a catch rigidly attached to said latch handle and extending away from said latch handle, said catch including a distal end having a hook portion adapted to engage the enclosure when said latch handle is in the latched position, and disengage from the enclosure when said latch handle is in the unlatched position;

at least one spring disposed between said pivot plate and said catch biasing said latch handle into the latched position;

each said spring having a first arm, and a second arm extending parallel to said first arm and interconnected with said first arm by a substantially arcuate portion, said first arm having a length greater than said second arm so that said spring has the shape of a hook; with one of said first and second arms contacting said pivot plate, and the other of said arms contacting said catch.

2. The latch assembly as set forth in claim 1 wherein each said spring is attached to said pivot plate at said second arm, with said first arm abutting said catch.

3. The latch assembly as set forth in claim 2 wherein each said spring is formed integral with said pivot plate.

4. The latch assembly as set forth in claim 3 wherein each said spring and said pivot plate are molded together of a plastic material.

5. The latch assembly as set forth in claim 1 wherein two springs extend between said pivot plate and said catch.

6. The latch assembly as set forth in claim 1 wherein said pivot plate extends from a first end to a second end, and from a top end to a bottom end, said at least one spring being disposed midway between said first and second ends at said top end.

7. The latch assembly of claim 1 wherein said first arm of each said spring includes an enlargement engaging said catch to bias said catch.

8. The latch assembly as set forth in claim 1 wherein said catch includes a plurality of ribs defining at least two channels on said catch for guiding each of said first arms of said springs.

9. The latch assembly as set forth in claim 1 wherein said pivot plate includes a plurality of reinforcing ribs for stiffening said pivot plate.

10. The latch assembly as set forth in claim 1 wherein said pivot plate includes a portion thereon for attaching said pivot plate to a door.

11. The latch assembly as set forth in claim 1 wherein said latch handle and said catch are molded together from plastic material.

* * * * *